United States Patent [19]

Maiffredy et al.

[11] 4,142,919

[45] Mar. 6, 1979

[54] MANUFACTURE OF ELONGATED BODIES OF HIGH STRENGTH CARBON STEEL

[75] Inventors: Lionel Maiffredy, Vaulz-en-Velin; Luc Peeters, Tronville-en-Barrois; Maurice Theolier, Vaulx-en-Velin, all of France

[73] Assignee: Sodetal, Societe Pour le Developpement du Filmentallique, Paris, France

[21] Appl. No.: 886,434

[22] Filed: Mar. 14, 1978

[30] Foreign Application Priority Data

Mar. 14, 1977 [FR] France ..... 77 07764

[51] Int. Cl.[2] ..... C21D 9/52

[52] U.S. Cl. ..... 148/12 R; 148/12 B

[58] Field of Search ..... 148/12 R, 12 B, 12.3

[56] References Cited

U.S. PATENT DOCUMENTS

| | | | |
|---|---|---|---|
| 3,580,746 | 5/1971 | Behar | 148/12 B |
| 3,674,570 | 7/1972 | Hallstrom et al. | 148/12 B |
| 3,810,793 | 5/1974 | Heller | 148/12 B |
| 3,939,015 | 2/1976 | Grange | 148/12 B |
| 3,959,999 | 6/1976 | Filatov et al. | 148/12 B |
| 4,016,009 | 4/1977 | Economopoulos et al. | 148/12 B |

*Primary Examiner*—W. Stallard

*Attorney, Agent, or Firm*—Sherman & Shalloway

[57] ABSTRACT

The invention relates to a process for the production of elongated bodies, made of hard or semi-hard steel, by operations which reduce their cross-section.

The process is characterized in that it comprises subjecting a body of high strength carbon steel to a first operation for reducing its cross-section essentially up to the limit of drawability, then heat treating the body at a temperature lower than the globulisation temperature of cementite so as to give the body further drawability, cooling the heat treated body to ambient temperature, and then subjecting the said body at ambient temperature to a second operation for reducing its cross-section.

This process may be used in particular in the drawing of wires for reinforcement of tires.

17 Claims, No Drawings

MANUFACTURE OF ELONGATED BODIES OF HIGH STRENGTH CARBON STEEL

The present invention relates to the production of elongated bodies, made of hard or semi-hard steel, by operations which reduce their cross-section. The new process may be used in working operations such as lamination, wire drawing and in particular, but not exclusively, the drawing of wires for the reinforcement of tyres.

Steel can be worked hot or cold. Hot working is carried out at a temperature at which the steel recrystallises. This makes it possible for substantial deformations to take place, but it leads to steels having a lower mechanical strength than those obtained by cold working, i.e. at ambient temperature.

The equilibrium structure of hard or semi-hard steel (carbon content greater than 0.4%) principally consists of, on the one hand, pearlite, formed from flakes of cementite (very hard and brittle iron carbide) in a matrix of eutectoid ferrite (very ductile almost pure iron) and, on the other hand, proeutectoid ferrite in an amount which depends on the heat treatment to which the steel has been subjected and on the composition (carbon content). The most suitable structure for wire drawing is that of an extremely fine pearlite. The operation called "lead patenting" results in a very close approximation to this structure.

Patenting consists in heating steel to a temperature (900° to 1,000° C.) at which the carbon is totally soluble in the iron. A phase in steel consisting of iron with carbon dissolved therein is called austenite. The steel is then immersed in molten lead at a temperature between 500° and 600° C. Cementite then precipitates out in the steel in the form of very fine flakes having a spacing which is so small that it cannot be resolved by the optical microscope. The patented steel so obtained can be worked cold, for example laminated or drawn into wire.

However, the cross-section of patented steel cannot be reduced indefinitely, whatever may be the quality of the initial structure. There is a working limit, which depends only to a slight extent on lubrication and beyond which wire drawing or other extension becomes impossible. For example, for a steel containing 0.7% of carbon, two patenting treatments are required for it to be possible to reduce a diameter of 5.5. mm to a diameter of 0.25 mm by cold working.

The hardening of steel during cold working can be summarised in simple terms by saying that, during deformation, linear defects (dislocations) are created, which oppose subsequent deformation. Cementite takes part in the deformation by breaking up and aligning itself along the direction of the deformation. It can therefore be understood that, when a certain density of defects is reached, deformations can no longer spread and this then causes the steel to crack or break.

The fact that it is necessary to carry out two patenting operations in order to reduce a steel wire from a diameter of 5.5 mm (machine wire) to a diameter of 0.25 mm (diameter of the fine wire which can be used, for example, in tyres), means that the wire is subjected to two heating operations at 900° to 1,000° C. and two immersions in molten lead at 500° and 600° C. This represents a rather long process. It has therefore been proposed to replace the process of cold working with patenting totally or partially by a more simple process.

The French Patent Application published under No. 2,078,026 describes a process for the manufacture of steel wire of small diameter and high strength, such as wire for reinforcing tyres. The process makes it possible to avoid patenting. To do this, hard carbon steel is replaced by alloyed steel having a low carbon content. The manufacturing process comprises the following phases: cold wire drawing by passage through several dies, heat treatment by annealing at 400°-650° C. and wire drawing at this temperature, optionally over several drawing cycles, each of several passes, until the final diameter is obtained. It is seen that patenting has been successfully eliminated, but at the expense of changing the type of steel. A special steel, which is expensive, is used. Furthermore, the wire drawing itself is not carried out by a cold process but by a semi-hot process, and this is likely to affect the surface of the wire, which becomes too rough. Now, the brassing which is necessary for steel wire to adhere to rubber must be carried out on a smooth surface. The document in question does not deal with problems which must arise in this connection. Furthermore, there is a risk of degrading the wire-drawing lubricants at the temperature of the treatment.

French Patent No. 1,495,846 describes a process for working, in particular, carbon steel wire. In the process for the manufacture of the fine wire, a patenting and cold working operation is replaced by a semi-hot working process at a temperature between ambient temperature and the recrystallisation temperature. In the example, the process starts with a patented wire which is cold drawn in several passes up to the limit of drawability. The wire is heated by induction to a temperature of between 100° and 500° C.; it is laminated at this temperature and then cooled. If necessary, the wire can then be subjected to a cold drawing operation. This process constitutes a compromise between cold wire drawing and hot wire drawing. However, it has disadvantages: on the one hand, at the temperature of the treatment, the viscosity of the wire-drawing lubricants decreases and there is a risk of degrading them; on the other hand, during the wire drawing at this temperature, the surface of the wire deteriorates and becomes rough, which renders the wire unsuitable for brassing and excludes its use as reinforcing wire for tyres. This process produces wires or elongated bodies which can be used for the manufacture of springs or as reinforcement for prestressed concrete, but it does not produce wires for the reinforcement of tyres.

French Patent No. 2,053,414 describes a process for the manufacture of a high strength steel wire, in which laminated steel wire is subjected successively to a series of cold drawing passes, to a spheroidisation annealing, to a cooling to a suitable temperature for carrying out the final drawing, and then to a second cold drawing operation. The spheroidisation annealing leads to the formation of globulised cementite. Now, in metallurgy, it is known that steel in the form of globulised cementite has very inferior mechanical properties, and is very unsuitable for subsequent wire drawing. Great difficulties must therefore be expected when the second series of wire drawing passes is carried out.

The present invention provides a new process for the manufacture of an elongated body of high strength carbon steel, which comprises subjecting the said body, at ambient temperature, to a first operation for reducing its cross-section essentially up to the limit of drawability, then heat treating the body at a temperature lower than the globulisation temperature of cementite, for a period of time which can range from a fraction of a second up to a few minutes, so as to give the body further drawability, cooling the heat-treated body to ambient temperature, and then subjecting the said body at ambient temperature to a second operation for reducing its cross-section. The heat treatment, the cooling and the second operation for reducing the cross-section are preferably carried out continuously. These operations can take place at high speeds which can be 1,000 meters/minute or more. The temperature of the heat treatment, which is lower than the globulisation temperature of cementite, is preferably between 400° and 600° C.

The duration of the heat treatment must be sufficient to bring the core of the elongated body to the desired temperature between 400° and 600° C. It depends on the power of the heating means, on the speed of travel of the elongated body and on the magnitude of its cross-section. In general terms, the duration of the heat treatment is between a fraction of a second and a few minutes. It is not detrimental to maintain the temperature for several tens of seconds, even when it is not necessary to do so.

The cooling may be carried out in a simple manner in the open air. In the case where the operations after the heat treatment follow each other continuously, the heat treatment must be sufficiently rapid for the elongated body to have returned to ambient temperature at the inlet of the first wire-drawing die.

The second operation for reducing the cross-section, which is carried out at ambient temperature, can advantageously be followed by a lead patenting treatment, by a cooling, by a surface treatment (for example brassing), and by an operation for reducing the cross-section at ambient temperature in order to obtain the desired cross-section and the desired mechanical properties.

However, the second operation for reducing the cross-section at ambient temperature can also be followed by a heat treatment at a temperature between 400° and 600° C., by cooling to ambient temperature, and a third operation for reducing the cross-section carried out at ambient temperature.

The steel used is preferably a steel containing from 0.4 to 0.8% of carbon, and elements which are usually present in this type of composition, such as manganese and silicon, may optionally be added.

The present process is particularly suitable for the manufacture of wire for reinforcing tyres. In this case, the starting element is so-called "machine wire", which is wire suitable for drawing obtained from a steelworks. in the usual method of manufacture, it has been subjected to a descaling, pickling and rinsing, and has received a coating of lime, borax or phosphate to assist drawing.

The mechanical heat treatment according to the invention makes it possible, at a relatively low temperature, to remove some of the dislocations and to give the metal further deformation capacity. This heat treatment makes it possible to prevent the diffusion of iron atoms, which would result in a coalescence of the cementite, which is very detrimental to the mechanical properties. (A globulised cementite no longer participates in the deformation; thus, the mechanical properties are those of the ferrite matrix and are therefore very weak.) The heat treatment makes it possible largely to remove the defects, whilst preventing coalescence of the cementite.

After heat treatment at 400°-600° C., the elongated body can optionally be subjected to an acid pickling. Likewise, before each operation for reducing the cross-section, it may receive an appropriate coating (e.g. of soap, phosphate or borax). However, the process of the invention makes it possible to eliminate the pickling and coating operations after heat treatment, as the heat treatment at between 400° and 600° C. does not damage either the surface or the coating. This is a substantial simplification.

An advantageous form of the treatment consists in heating the elongated element at a temperature of 400° to 600° C. for a few seconds using, for example, a high frequency inductor, a device operating by the Joule effect, a gas burner or the like.

Wires obtained by the process of the invention exhibit mechanical properties which are considerably better than those of the wires obtained by the conventional process using patenting; the tensile strength is considerably higher and the hardness is also greater. These wires constitute a valuable product which can be used in the manufacture of submarine cables, springs, load-carrying ropes, handling ropes and the like. However, after subsequent treatment by patenting and drawing, the wires are perfectly suitable for reinforcing tyres. They then exhibit the same mechanical properties as wires obtained by the conventional process comprising two patenting operations and, in addition, they behave better in respect of fatigue.

The invention is illustrated by the following Example which describes the manufacture of wires for the reinforcement of tyres.

The process starts with a laminated steel wire containing 0.7% of carbon and having a diameter of 5.5 mm, which originates from a steelworks and has been subjected to a controlled cooling. This wire, which is suitable for drawing, is initially descaled, pickled and rinsed and it receives a coating of phosphate and borax. The wire is then cold drawn down to a diameter of 3 mm in seven passes. The wire is then subjected to a heat treatment for a few seconds at 400° C. using a high frequency inductor controlled by an infra-red pyrometer, so as to give the wire further drawability. In a continuous process with the heat treatment, the wire is cooled to ambient temperature and then subjected to another drawing operation at ambient temperature, which is also carried out continuously. The diameter of 3 mm is reduced to a diameter of 1.25 mm in nine passes. The wire is wound up on a support. The wire of 1.25 mm diameter is subjected to a conventional patenting operation in order to give it further drawability, and it is subjected to a continuous process of pickling in an acid bath and rinsing with water, and it then receives an electrolytic coating of brass. The 1.25 mm wire, which has been brassed, rinsed and dried, is subjected to its final drawing operation in which the fine wire of 0.25 mm diameter is obtained in 19 passes. This wire can then be used for finishing operations such as cord threading and cabling.

The table below compares the characteristics, at the different stages of manufacture, of a wire obtained by the conventional process and of a wire obtained by the process according to the invention.

It is found that the finished wire (0.25 mm diameter) obtained by the process of the invention and the finished wire obtained by the conventional process have equivalent mechanical properties (TS and El). The other properties, namely twisting and bending properties, are also identical, but the fatigue characteristics of the strand in accordance with the invention are superior.

| Diameters of the wire in mm | Characteristics | Standard process wire with Patenting | Wire process according to the invention |
|---|---|---|---|
| Wire 5.5 | TS | 1,040 MPa | |
| | El | 10% | |
| | C | 40% | |
| Predrawn wire 3 | TS | 1,510 | |
| | El | 3.4 | |
| Wire 3 + heat treatment | TS | 1,180 | 1,345 |
| | El | 9.3 | 12.7 |
| | C | 55 | 43 |
| Drawn wire 1.25 | TS | 1,785 | 2,273 |
| | El | 3 | 3.2 |
| Patented and brassed wire 1.25 | TS | 1,205 | 1,200 |
| | El | 9.5 | 9.10 |
| Fine wire 0.25 | TS | 2,760 | 2,780 |
| | El | 2.10 | 2.05 |

TS = Tensile strength in Mega-Pascal
El = Elongation at break in %, measured on 50 cm
C = Constriction.

As regards the intermediate product (drawn wire 1.25 mm), the wire obtained by the process of the invention exhibits mechanical properties which are distinctly superior to those of the wire obtained by the conventional process. These properties are exceptional for a wire of 1.25 mm diameter and containing 0.7% of carbon, which has been obtained from a 5.5. mm steel wire which has undergone cooling in a steelworks. This wire can be employed in uses such as submarine cables, springs and the like. The process of the invention makes it possible to achieve this result directly.

The invention offers numerous advantages:

Replacement of patenting by a simpler process, ease of processing, and simplified equipment which is therefore less expensive;

no damage to the surface of the wire;

no damage to the coatings, which makes it possible to eliminate the pickling and coating operations after the heat treatment and before the second wire drawing, giving a saving on equipment, raw materials and energy;

possibility of operating continuously, after the heat treatment, and at high speeds of up to 1,000 meters/minute or more; and production of a product exhibiting mechanical properties which are superior to those of products obtained by the conventional process, it being possible for this product to be considered as a finished product and used as it is or as an intermediate product. In the latter case, it leads to a finished product (for example, wire for tyres) which exhibits the same properties as the product obtained by the conventional process.

These results are obtained with the type of carbon steel usually employed.

The invention is applicable to all processes for working elongated bodies of carbon steel, such as the lamination of profiles, wire-drawing processes and the like.

What we claim is:

1. A process for the manufacture of an elongated body of high strength carbon steel, which comprises subjecting a body of such steel, at ambient temperature, to a first operation for reducing its cross-section essentially up to the limit of drawability, then heat treating the body at a temperature lower than the globulisation temperature of cementite so as to give the body further drawability, cooling the heat treated body to ambient temperature, and then subjecting the said body at ambient temperature to a second operation for reducing its cross-section.

2. The process according to claim 1, in which the temperature of the heat treatment is between 400° and 600° C.

3. The process according to claim 1 or 2, in which the heat treatment, the cooling and the second operation for reducing the cross-section are carried out continuously.

4. The process according to claim 3, in which the heat treatment, the cooling and the second operation for reducing the cross-section are carried out at a speed of 1,000 meters/minute or greater.

5. The process according to any one of claims 1 or 2, in which the second operation for reducing the cross-section is followed by a patenting treatment, and then by a third operation for reducing the cross-section at ambient temperature.

6. The process according to any one of claims 1 or 2, in which the second operation for reducing the cross-section is followed by a second heat treatment at a temperature of between 400° and 600° C., and by a third operation for reducing the cross-section at ambient temperature.

7. The process according to any one of claims 1 or 2 in which the body of high strength carbon steel is a wire and the operations for reducing the cross-section comprise drawing the wire through one or more dies.

8. The process according to any one of claims 1 or 2 in which the said body is made by the said process into carbon steel wire for the reinforcement of tyres.

9. The process according to claim 4 in which the second operation for reducing the cross-section is followed by a patenting treatment, and then by a third operation for reducing the cross-section at ambient temperature.

10. The process according to claim 4 in which the second operation for reducing the cross-section is followed by a second heat treatment at a temperature of between 400° and 600° C., and by a third operation for reducing the cross-section at ambient temperature.

11. The process according to claim 3 in which the second operation for reducing the cross-section is followed by a patenting treatment, and then by a third operation for reducing the cross-section at ambient temperature.

12. The process according to claim 3 in which the second operation for reducing the cross-section is followed by a second heat treatment at a temperature of between 400° and 600° C., and by a third operation for reducing the cross-section at ambient temperature.

13. The process according to claim 11 in which the body of high strength carbon steel is a wire and the operations for reducing the cross-section comprise drawing the wire through one or more dies.

14. The process according to claim 12 in which the body of high strength carbon steel is a wire and the operations for reducing the cross-section comprise drawing the wire through one or more dies.

15. The process according to claim 1 in which the high strength carbon steel contains from 0.4 to 0.8% of carbon.

16. The process according to claim 1 wherein said body of high strength carbon steel is a machine wire having an initial diameter of about 5.5 mm.

17. The process according to claim 6 in which the body of high strength carbon steel has a carbon content of about 0.4 to about 0.7 wt.%, has an initial diameter of about 5.5 mm and has a final diameter after the third operation for reducing the cross-section at ambient temperature of about 0.25 mm.

* * * * *